US006443777B1

(12) United States Patent
McCurdy et al.

(10) Patent No.: US 6,443,777 B1
(45) Date of Patent: Sep. 3, 2002

(54) INDUCTIVE CROSSTALK COMPENSATION IN A COMMUNICATION CONNECTOR

(75) Inventors: Alan H. McCurdy, Deluth, GA (US); Julian R. Pharney, Indianapolis, IN (US); David L. Reed, Fountaintown, IN (US); Ted E. Steele, Greenfield, IN (US); Paul J. Straub, Mooresville, IN (US)

(73) Assignee: Avaya Technology Corp., Basking Ridge, NJ (US)

( * ) Notice: Subject to any disclaimer, the term of this patent is extended or adjusted under 35 U.S.C. 154(b) by 0 days.

(21) Appl. No.: 09/887,147

(22) Filed: Jun. 22, 2001

(51) Int. Cl.[7] ..... H01R 24/00
(52) U.S. Cl. ..... 439/676; 439/941; 439/76.1
(58) Field of Search ..... 439/676, 941, 439/76.1, 344

(56) References Cited

U.S. PATENT DOCUMENTS 5,700,167 A 12/1997 Pharney et al.
5,911,602 A * 6/1999 Vaden ..... 439/941
5,997,358 A 12/1999 Adriaenssens et al.
6,120,329 A * 9/2000 Steinman ..... 439/941
6,139,371 A 10/2000 Troutman et al.
6,196,880 B1 3/2001 Goodrich et al.

OTHER PUBLICATIONS

Bell Telephone Laboratories, Transmission Systems for Communications (5TH ED. 1982) at pp. 127–132.

* cited by examiner

*Primary Examiner*—Tho D. Ta

(57) ABSTRACT

A communication jack has a first pair and a second pair of contact wires defining corresponding signal paths in the jack. Parallel, co-planar free end portions of the wires are formed to connect electrically with a mating connector that introduces offending crosstalk to the signal paths. First free end portions of the first pair of contact wires are supported adjacent one another, and second free portions of the second pair are supported adjacent corresponding ones of the first free end portions. Intermediate sections of the first pair of contact wires diverge vertically and traverse one another to align adjacent to corresponding intermediate sections of the second pair of wires, to produce sufficient inductive compensation coupling to counter the offending crosstalk from the plug. Capacitive compensation coupling may be obtained for the contact wires via one or more printed wiring boards supported on or in the jack housing.

15 Claims, 5 Drawing Sheets

INDUCTIVE CROSSTALK COMPENSATION IN A COMMUNICATION CONNECTOR

BACKGROUND OF THE INVENTION

1. Field of the Invention

This invention relates to communication connectors that are configured to compensate for offending crosstalk.

2. Discussion of the Known Art

Communication connectors that are configured to suppress or to compensate for crosstalk that is introduced by a mating connector, are generally known. As defined herein, crosstalk arises when signals conducted over a first path, e.g., a pair of contact wires in a communication plug connector, are partly coupled electromagnetically into a second signal path (e.g., another pair of contact wires) within the same connector. Signals coupled from the first path into the second path may be detected as "crosstalk" in the second path, and they tend to degrade existing signals that are being routed through the second path. For a disturbing signal of a given amplitude, the amplitude of associated crosstalk will increase with the frequency or the data rate of the disturbing signal.

Applicable industry standards for rating connector crosstalk performance are given in terms of near-end crosstalk: (NEXT) and far-end crosstalk (FEXT). The ratings are typically specified for mated combinations of plug and jack connectors, and input terminals of the plug connector may be used as a reference plane. For a given signal path through the mated connectors, NEXT is defined as crosstalk whose power travels in an opposite direction to that of an originating, disturbing signal in a different path, while FEXT is defined as crosstalk whose power travels in the same direction as the disturbing signal in the different path. See "Transmission Systems For Communications", Bell Telephone Laboratories (5th ed. 1982), at page 130.

Communication links using cables comprised of unshielded twisted pairs (UTP) of copper wire are now expected to meet industry "Category 6" standards. These standards call for at least 54 dB NEXT loss and 43 dB FEXT loss when the frequency of the disturbing signal is at 100 MHz.

Crosstalk compensation circuitry may be provided on or within layers of a printed wiring board associated with a communication jack. See U.S. Pat. No. 5,997,358 (Dec. 7, 1999), all relevant portions of which are incorporated by reference. U.S. Pat. No. 6,139,371 (Oct. 31, 2000), also incorporated by reference, relates to a communication connector assembly having capacitive crosstalk compensation. The assembly features a number of terminal contact wires at least first and second pairs of which have free end portions that extend to define leading portions. A leading portion of a first pair of contact wires, and a leading portion of a second pair of contact wires, are dimensioned and arranged for capacitively coupling to one another so as to produce capacitive crosstalk compensation.

See also commonly owned U.S. applications Ser. No. 09/583,503 filed May 31, 2000, entitled "Communication Connector with Crosstalk Compensation"; and Ser. No. 09/664,814 filed Sep. 19, 2000, U.S. Pat. No. 6,350,158 entitled "Low Crosstalk Communication Connector" wherein free ends of contact wires in a communication jack are urged by a mating plug into contact with pads on a printed wiring board. Capacitance elements in the printed wiring board connected between the pads provide capacitive compensation coupling, and co-planar intermediate portions of the contact wires within the jack are positioned relative to one another to obtain inductive compensation coupling.

To compensate for NEXT and FEXT simultaneously in a communication jack, crosstalk which is developed capacitively by a mating plug should preferably be offset by corresponding capacitive compensation coupling within the jack, while crosstalk developed inductively by the plug should be countered by appropriate inductive compensation coupling within the jack. By providing both the capacitive and the inductive compensation coupling as close as possible to the plug/jack electrical interface, detrimental effects arising from time delays between the source of offending crosstalk (the plug) and stages where compensation is provided (e.g., contact wires and printed wiring board(s) in the jack), are minimized.

For example, the jack of the mentioned U.S. Pat. No. 6,139,371 reduces time delays for capacitive compensation coupling by deploying such coupling at the free ends of the jack contact wires where no signal currents flow. The jack of the mentioned U.S. application Ser. No. 09/664,814 also introduces capacitive compensation coupling at the non-current carrying free ends of jack contact wires, in cooperation with a secondary printed wiring board.

U.S. Pat. No. 6,086,428 (Jul. 11, 2000) which is assigned to the present assignee, discloses a crosstalk compensating connector jack in which portions of two pairs of contact wires are supported at two different levels on a dielectric support block to obtain inductive compensation coupling between the pairs of contact wires.

While at least some inductive compensation may be obtained by the contact wires themselves, capacitive compensation can be obtained only by the use of capacitance elements on one or more associated printed wiring boards. In a so-called multi-stage arrangement, a relatively high level of capacitive coupling is provided at the non-current carrying free ends of contact wires in a jack connector, and a second stage of capacitive compensation coupling is provided by elements on a printed wiring board to which bases of the contact wires are electrically connected.

In the arrangement of U.S. Pat. No. 6,086,428; inductive compensation coupling of about 9.2 millivolts per volt per inch (mv/v/in) is obtained by coupling intermediate sections of the pair 1 and the pair 3 contact wires with one another at first and second levels staggered in height by about 0.10 inch on a dielectic block. Because a typical level of offending inductive crosstalk introduced by a mating plug connector is about 7 mv, a coupling length of, about 0.8 inch is needed to produce adequate inductive compensation coupling. If the signal time delay from the plug/jack interface to the effective point of inductive compensation coupling becomes too great, efficient near-end crosstalk (NEXT) compensation may not be obtained. Increasing the distance between the two levels of coupled intermediate sections from 0.10 to 0.15 inch obtains about 20.6 mv/v/in of inductive compensation, thus requiring a shorter length of only 0.35 inch for the coupling region. But this length would need to be increased again if more compensation is required as part of a multistage compensation scheme.

There remains a need for a communication connector in which a significant amount of inductive compensation coupling can be developed over a relatively short distance so that both NEXT and FEXT performance are enhanced. Providing sufficient inductive compensation via the terminal wires in the jack also permits good FEXT performance to be achieved without the need for printing inductive loops on associated wiring board structures. This allows for "capacitive only" compensation on the printed wiring boards, which occupies less space on such boards where available space is at a premium.

SUMMARY OF THE INVENTION

According to the invention, a communication connector assembly includes a terminal contact wire support, a first pair of contact wires defining a first signal path in the assembly, and a second pair of contact wires defining a second signal path in the assembly. The contact wires have bases fixed on the contact wire support, and parallel co-planar free end portions arranged to make electrical contact with a mating connector that introduces offending crosstalk to the first and the second signal paths. First free end portions of the first pair of contact wires are supported adjacent to one another, and second free end portions of the second pair of contact wires are supported adjacent to corresponding ones of the first free end portions.

The contact wires are configured so that first intermediate sections of the first pair of contact wires diverge vertically apart with respect to the plane of the first free end portions, and traverse one another to align adjacent to corresponding second intermediate sections of the second pair of contact wires with a first spacing for obtaining inductive compensation coupling with respect to the offending crosstalk introduced by the mating connector, the second intermediate sections also diverging vertically apart from one another with respect to the plane of the second free end portions. The coupled first and second intermediate sections extend in corresponding parallel planes having a second spacing, and the second spacing between the planes containing the coupled intermediate sections is set to obtain a desired level of inductive compensation coupling among the contact wires in the absence of additional inductive compensation coupling for the connector assembly.

According to one aspect of the invention, cross-sections of the coupled intermediate sections of the first and the second pairs of contact wires define corners of a rectangle.

According to another aspect of the invention, the connector assembly forms part of a communication jack, and a wiring board is supported in a jack housing wherein the wiring board has pads for contacting free ends of the contact wires to provide a first stage of capacitive coupling.

DETAILED DESCRIPTION OF THE INVENTION

Figure 1:
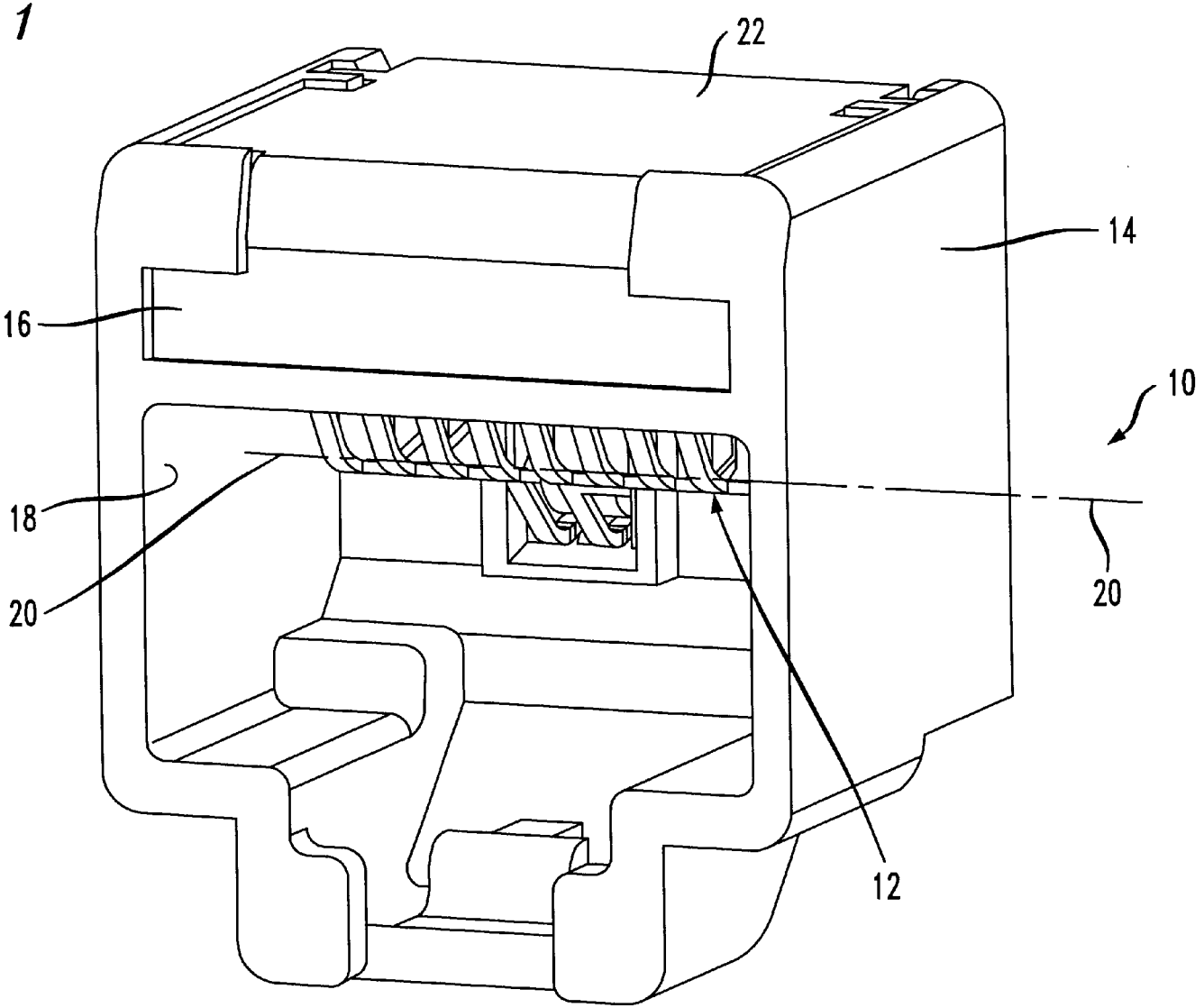
FIG. 1 is a perspective view of a communication jack, according to the invention.
Figure 2:
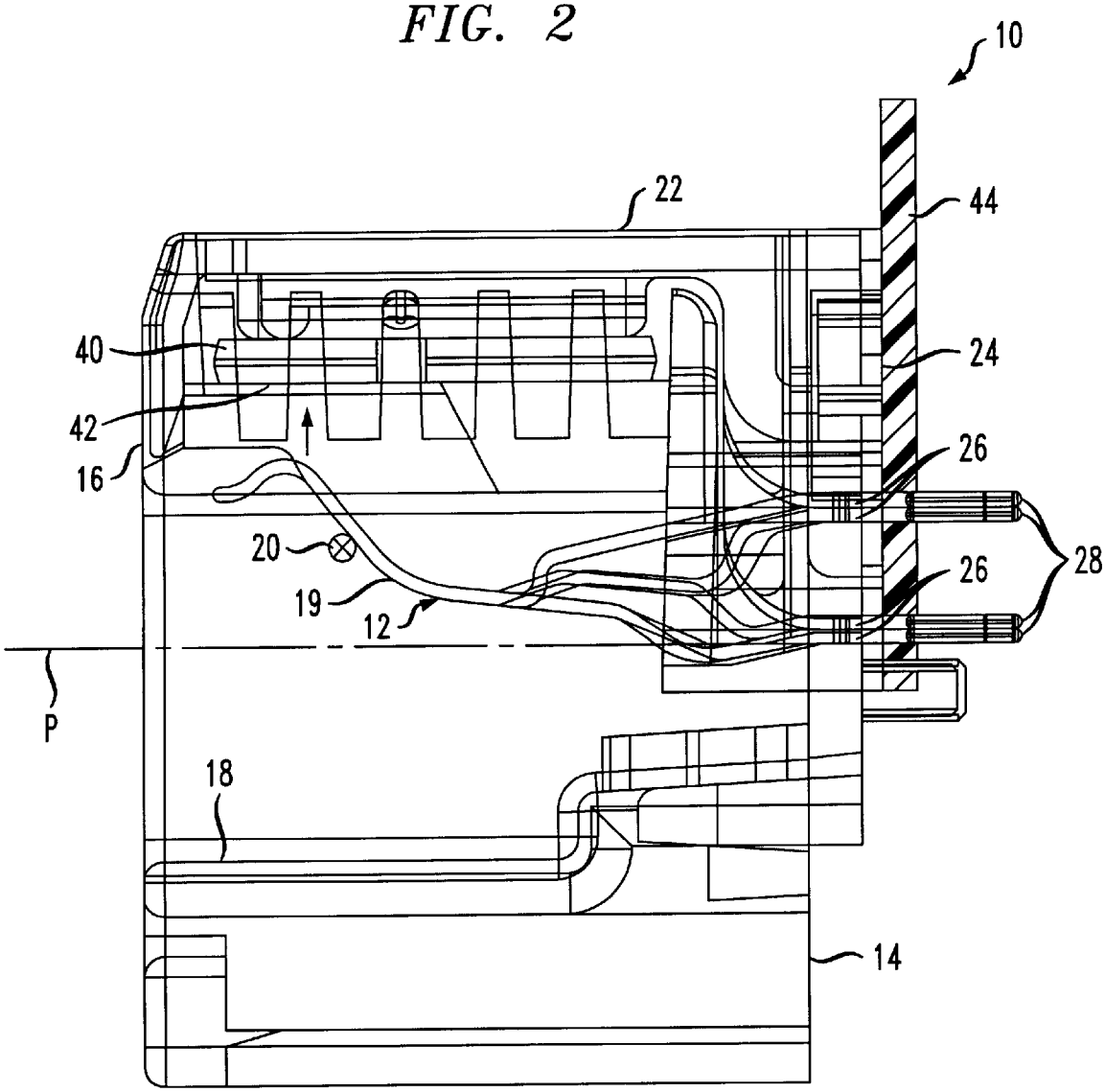
FIG. 2 is a side view of the jack in FIG. 1, showing terminal contact wires arranged inside the jack according to the invention.
Figure 3:
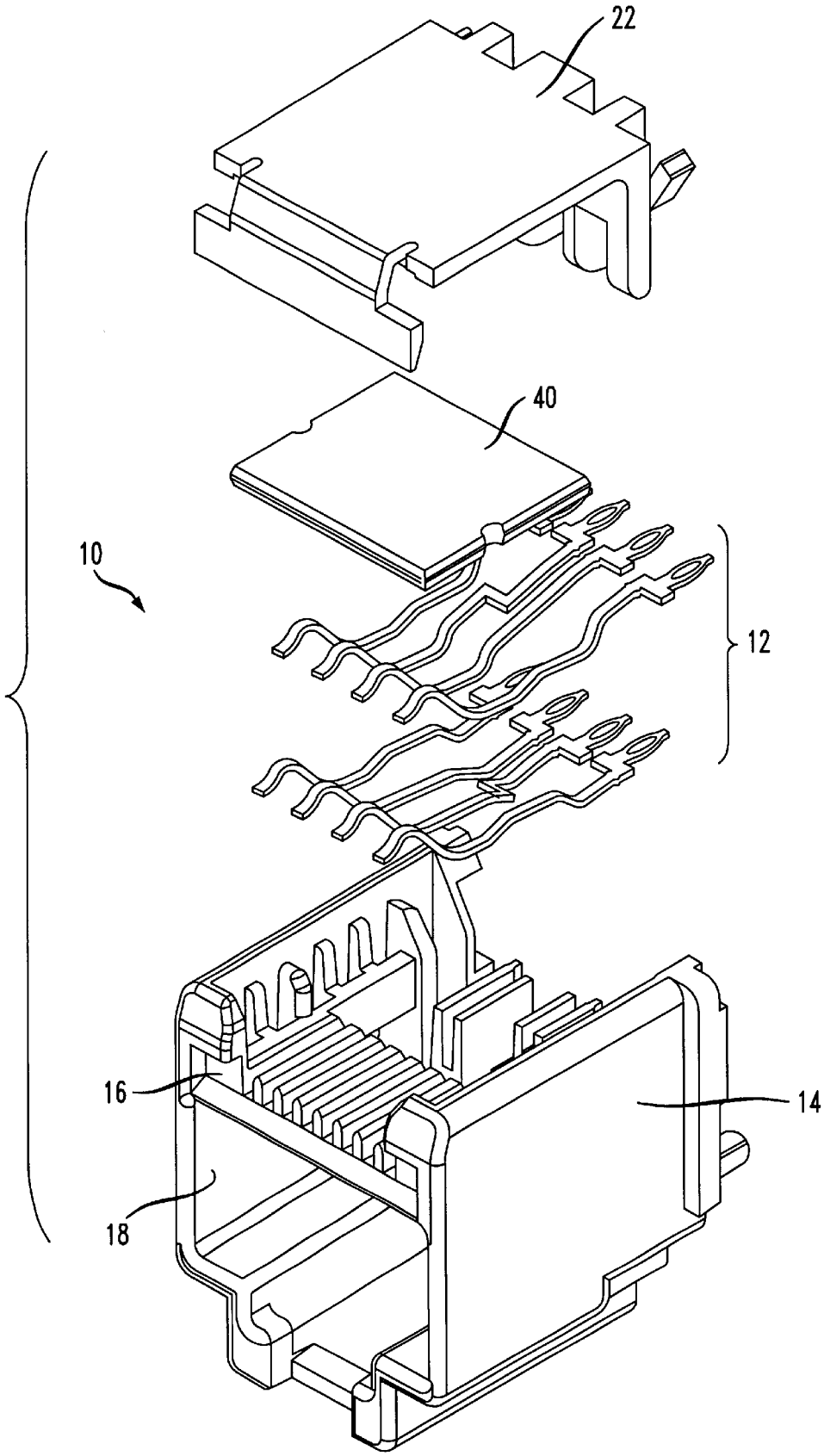
FIG. 3 is an exploded, assembly view of the jack in FIG. 1.

FIG. 1 shows a communication jack 10 in which inductive crosstalk compensation coupling is obtained according to the invention. FIG. 2 is a side view of the jack in FIG. 1, showing a set of terminal contact or "lead frame" wires 12 supported inside of the jack 10, and FIG. 3 is an exploded assembly view: of the jack 10.

The jack 10 includes a jack housing 14 made of a suitable insulative plastics material that meets all applicable standards with respect: to electrical breakdown resistance and flammability. Typical materials include, but are not limited to, polycarbonate, ABS, and blends thereof.

The contact wires 12 may be formed of a copper aloy such as spring-tempered phosphor bronze, beryllium copper, or the like. A typical cross section of each wire is 0.017 inch wide by 0.010 inch thick.

The housing 14 has a front wall 16, and a plug opening 18 formed in the front: wall 16 to allow a mating plug connector (not shown) to be received within the jack housing 14 along the direction of a plug axis P (FIG. 2) which is normal to the front wall 16 of the jack housing 14. When a mating plug is received in the plug opening 18, free end portions 19 of the contact wires 12 establish electrical contact with corresponding terminals of the mating connector along a plug/jack contact line or interface 20 on the free end portions.

As seen in FIGS. 1–3, a generally "L" shaped cover 22 extends across the top of the jack housing 14, and part of the cover 22 forms an upper portion of a rear wall 24 of the housing 14. Each of the terminal contact wires 12 has a base 26 that is captured within corresponding vertical slots formed in the housing rear wall 24, and an outside terminal 28 that projects rearwardly of the jack 10 to connect electrically with one or more outside wire leads.

The free end portions 19 of the contact wires 12 are; aligned parallel and generally co-planar with one another, as seen in FIGS. 1 and 2. The free end portions 19 are spaced apart from one another by, e.g., 0.04.0 inch, and they connect electrically with blade terminals of a mating plug connector along the plug/jack interface 20. In the disclosed embodiment, eight contact wires 12 define four signal paths through the jack 10, wherein selected pairs of the free end portions 19 of the contact wires define the signal paths, per Part 68 of the applicable FCC Rules, 47 C.F.R. §68.502. The adjacent fourth and fifth contact wires counting from the left in FIG. 1 define a so-called "pair 1" signal path, and the third and the sixth contact wires which are adjacent to the fourth and the fifth contact wires, respectively, define a so-called "pair 3" signal path through the jack 10.

Typically, a greatest amount of offending crosstalk is developed in plug connectors among the pair 1 and the pair 3 signal paths. It is therefore desirable to obtain equal and opposite levels of both inductive and capacitive crosstalk compensation among the pair 1 and the pair 3 contact wires 12, in the region between the plug/jack interface 20 and the bases 26 of the contact wires at the rear wall 24 of the jack housing.

The present jack 10 also includes a printed wiring board 40 that is supported within the jack housing 14, above the free end portions 19 of the contact wires 12 and beneath the top cover 22. See FIGS. 2 and 3. The printed wiring board 40 has a number of contact pads 42 arrayed adjacent to a front edge of the board, wherein the pads 42 are operatively aligned with corresponding ones of the free end portions 19 of the contact wires 12. Capacitance elements (not shown)

on or within layers of the printed wiring board 40 have terminals which are connected to corresponding pairs of the contact pads 42.

As indicated in FIG. 2, when a plug is received in the jack housing 14 along the direction of plug axis P, terminals of the plug engage the free end portions 19 of the contact wires 12 and urge the free end portions 19 upward to contact the pads 42 on the printed wiring board 40. Capacitive coupling is thus produced at non-current carrying free ends of the contact wires to compensate for offending crosstalk introduced by the mating plug. To supply sufficient capacitive compensation as part of a multi-stage configuration, a second stage of capacitive coupling may be introduced via a second printed wiring board 44 connected to the bases 26 of the contact wires 12 at the rear of the jack housing 14. See commonly owned co-pending U.S. application Ser. No. 09/664,814 filed Sep. 19, 2000, entitled "Low Crosstalk Communication Connector".

Figure 4:
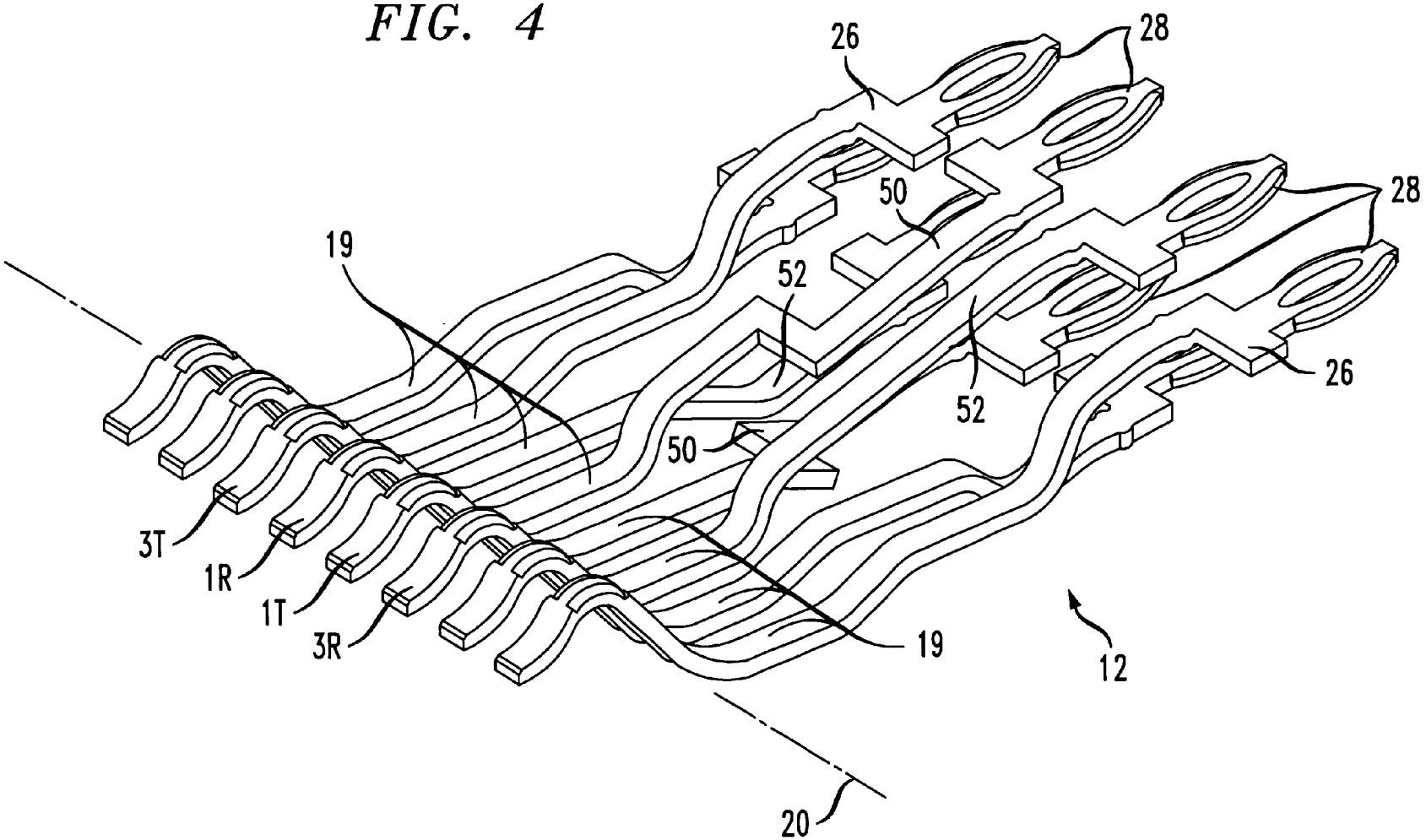
FIG. 4 shows a configuration of the contact wires in the assembled jack.
Figure 5:
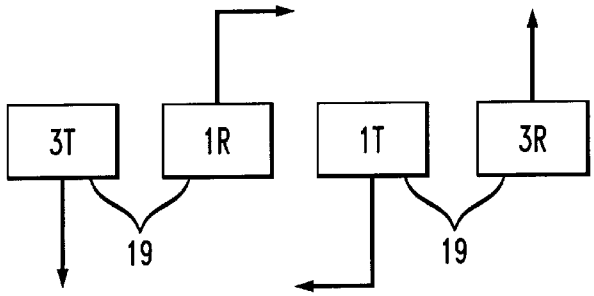
FIG. 5 shows cross sections of free end portions of the two pairs of contact wires as taken along a plug/jack contact line in FIGS. 1, 2 and 4.

FIG. 4 shows a configuration of the terminal contact wires 12 as supported in the assembled communication jack 10, and FIG. 5 represents cross sections of the free end portions 19 of the pair 1 and the pair 3 contact wires, as taken along the plug/jack contact line 20. The fourth and the fifth contact wires as counted from the left in FIG. 1, are labeled 1R (ring) and 1T (tip) in FIG. 5. Also, in FIG. 5, the third and the sixth contact wires counted from the left in FIG. 1 are labeled 3T and 3R.

Figure 6:
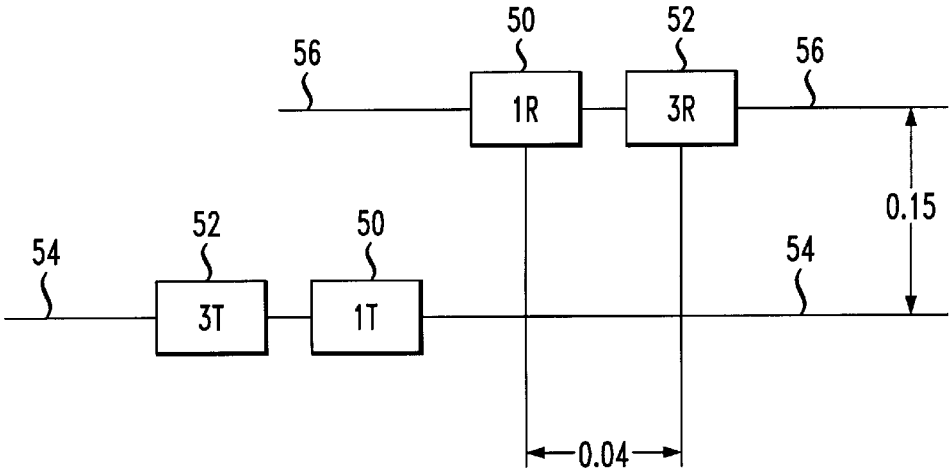
FIG. 6 shows cross sections of two sets of coupled intermediate sections of the contact wires in FIG. 5, in a first embodiment of the invention.

FIG. 6 represents cross sections of aligned intermediate section 50, 52 of the pair 1 and the pair 3 contact wires, according to a first embodiment of the invention. As indicated in FIGS. 5 and 6, first intermediate sections 50 of the pair 1 contact wires are formed to diverge vertically apart with respect to the plane of the free end portions of the pair 1 contact wires, and traverse one another to align and couple inductively with corresponding second intermediate sections 52 of the pair 3 contact wires with a first spacing (e.g., 0.040 in.). As shown in FIGS. 5 and 6, the second intermediate sections 52 also diverge vertically apart with respect to the plane of the free end portions of the pair 3 contact wires. Inductive compensation coupling is thus obtained with respect to offending crosstalk introduced on the pair 1 and the pair 3 wires by a mating plug connector. The intermediate section 50 of the "1T" contact wire and the intermediate section 52 of the "3T" contact wire in FIG. 6, are aligned adjacent to one another and extend in a first plane 54. The intermediate section 50 of the "1R" contact wire and the intermediate section 52 of the "3R" contact wire in FIG. 6, are aligned adjacent to one another and extend in a second plane 56. Cross sections of the two sets of coupled intermediate sections 50, 52 in FIG. 6 are thus disposed at corresponding corners of a parallelogram.

The first and the second planes are separated by a distance set to obtain an adequate level of inductive compensation coupling among the jack contact or lead frame wires 12, without additional inductive coupling such as by loops printed on an associated wiring board. Such distance may vary from about 0.08 to as much as 0.15 inch, with the level of inductive compensation coupling between each pair of coupled intermediate sections increasing as the separation distance between their corresponding planes increases. For example, a separation of about 0.10 inch may be sufficient to compensate for plugs that meet current TIA requirements with respect to inductively induced crosstalk.

The separation between coupled intermediate sections 50, 52 in each of the two planes 54, 56 (e.g., 0.040 inch), is less than the separation distance set between the planes 54, 56 containing each pair of coupled sections. With the configuration of FIG. 6 and a separation of 0.15 inch between the planes 54, 56, inductive compensation coupling of about 45 mv/v/in has been obtained. This represents an improvement by a factor of two compared with the contact wire configuration in the mentioned '428 patent with a corresponding separation of 0.15 inch. Thus, the overall length of the contact wires 12 in the present jack 10 may be reduced by as much as one-half, further decreasing the signal time delay between the plug/jack interface 20 and the point at which the desired inductive compensation coupling becomes effective.

Figure 7:
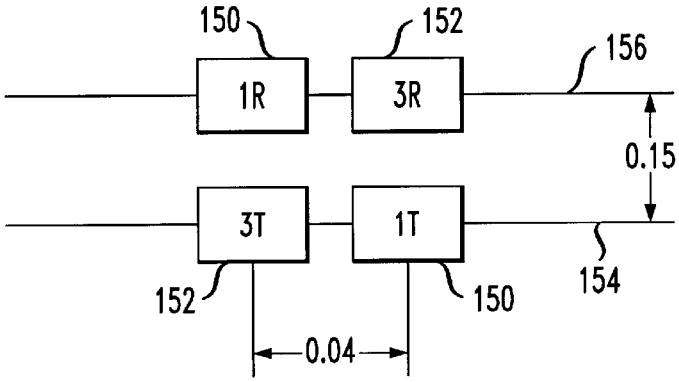
FIG. 7 shows cross sections of two sets of coupled intermediate sections of the contact wires in FIG. 5, according to a second embodiment of the invention.

FIG. 7 shows cross sections of coupled intermediate sections 150, 152 of the pair 1 and the pair 3 contact wires 12 within the jack housing 14, in a second embodiment of the invention. With the spacing between the coupled intermediate sections 150, 152 in each plane 154, 156 set at 0.040 inch, and the separation between the planes 154, 156 containing the coupled sections set at 0.15 inch, inductive compensation coupling of about 42 mv/v/in has been obtained. The cross sections of the two sets of coupled intermediate sections 150, 152 in FIG. 7 are aligned vertically and disposed at corresponding corners of a rectangle.

With a second stage of capacitive compensation coupling provided via the rear printed wiring board 44 in FIG. 2, both near-end and far-end crosstalk may be reduced or canceled simultaneously. Since the necessary inductive compensation coupling is provided entirely by the present configurations for the contact (lead frame) wires 12, only capacitive compensation coupling may need to be provided on or within layers of the board 44.

While the foregoing description represents preferred embodiments of the invention, it will be understood by those skilled in the art that various modifications may be made without departing from the scope of the invention pointed out by the following claims.

We claim:

1. A communication connector assembly, comprising:

a terminal contact wire support;

a first pair of contact wires defining a first signal path in the assembly;

a second pair of contact wires defining a second signal path in the assembly;

the contact wires have bases fixed on the contact wire support, and parallel co-planar free end portions arranged to make electrical contact with corresponding terminals of a mating connector which introduces offending crosstalk to the first and the second signal paths in the assembly;

first free end portions of the first pair of contact wires are supported adjacent to one another, and second free end portions of the second pair of contact wires are supported adjacent to corresponding ones of the first free end portions;

the contact wires are configured so that first intermediate sections of the first pair of contact wires diverge vertically apart with respect to the plane of the first free end portions and traverse one another to align adjacent to corresponding second intermediate sections of the second pair of contact wires with a first spacing for obtaining inductive compensation coupling with respect to the offending crosstalk introduced by the mating connector, wherein the second intermediate sections diverge vertically apart with respect to the plane of the second free end portions, and the coupled first and second intermediate sections extend in corresponding parallel planes having a second spacing;

the second spacing between the planes containing the coupled intermediate sections is set to obtain a desired level of inductive compensation coupling among the contact wires in the absence of additional inductive compensation coupling for the connector assembly; and wherein cross sections of the coupled intermediate sections of the first and the second pairs of contact wires define corners of a rectangle.

2. A communication connector assembly according to claim 1, wherein the free end portions of the contact wires are spaced apart from one another by a distance of about 0.040 inch.

3. A communication connector assembly according to claim 1, wherein the first spacing between the coupled first and second intermediate sections of the contact wires is about 0.040 inch.

4. A communication connector assembly according to claim 1, wherein the second spacing between the planes of the coupled first and second intermediate sections is greater than the first spacing between the coupled intermediate sections of the contact wires.

5. A communication connector assembly according to claim 4, wherein the second spacing between the planes containing the first and the second intermediate sections is at least about 0.08 inch.

6. A communication connector assembly according to claim 5, wherein the second spacing is about 0.10 inch.

7. A communication jack, comprising:

a jack housing including a front wall forming a plug opening which has a plug axis normal to the front wall, and a rear wall;

a terminal contact wire support in the region of the rear wall of the housing;

a first pair of contact wires defining a first signal path in the jack;

a second pair of contact wires defining a second signal path in the jack;

the contact wires have bases fixed on the contact wire support, and parallel co-planar free end portions arranged to make electrical contact with corresponding terminals of a mating plug which introduces offending crosstalk to the first and the second signal paths in the jack;

first free end portions of the first pair of contact wires are supported adjacent to one another and second free end portions of the second pair of contact wires are supported adjacent to corresponding ones of the first free end portions;

the contact wires are configured so that first intermediate sections of the first pair of contact wires diverge vertically apart with respect to the plane of the first free end portions and traverse one another to align adjacent to corresponding second intermediate sections of the second pair of contact wires with a first spacing for obtaining inductive compensation coupling with respect to the offending crosstalk introduced by the plug, wherein the second intermediate sections diverge vertically apart with respect to the plane of the second free end portions, and the coupled first and second intermediate sections extend in corresponding parallel planes having a second spacing;

the second spacing between the planes containing the coupled intermediate sections is set to obtain a desired level of inductive compensation coupling among the contact wires in the absence of additional inductive compensation coupling for the communication jack; and a first wiring board supported in the jack housing, wherein the first wiring board has pads for contacting free ends of the contact wires to provide a first stage of capacitive coupling.

8. A communication jack according to claim 7, wherein free end portions of the contact wires are spaced apart from one another by a distance of about 0.040 inch.

9. A communication jack according to claim 7, wherein the first spacing between the coupled first and second intermediate sections of the contact wires is about 0.040 inch.

10. A communication jack according to claim 7, wherein cross sections of the coupled intermediate sections of the first and the second pairs of contact wires define corners of a parallelogram.

11. A communication jack according to claim 7, wherein cross sections of the coupled intermediate sections of the first and the second pairs of contact wires define corners of a rectangle.

12. A communication jack according to claim 7, including a second wiring board supported by the jack housing, wherein the wiring board is electrically connected to the bases of the terminal contact wires to provide a second stage of capacitive coupling.

13. A communication jack according to claim 7, wherein the second spacing between the planes of the coupled first and second intermediate sections is greater than the first spacing between the coupled intermediate sections of the contact wires.

14. A communication jack according to claim 13, wherein the second spacing is at least about 0.08 inch.

15. A communication jack according to claim 14, wherein the second spacing is about 0.10 inch.

* * * * *